US006151991A

United States Patent [19]

Seville

[11] Patent Number: 6,151,991

[45] Date of Patent: Nov. 28, 2000

[54] TERRA COTTA SHARPENING BLOCK

[76] Inventor: Frank Seville, 1710 Purdue Ave. #106, West Los Angeles, Calif. 90025

[21] Appl. No.: 09/288,111

[22] Filed: Apr. 8, 1999

[51] Int. Cl.[7] ..... B24B 3/36

[52] U.S. Cl. ..... 76/82; 76/81.3; 451/444; 451/491

[58] Field of Search ..... 76/82, 82.2, 83, 76/82.1, 81.3; 451/555, 461, 444, 552, 491, 65, 66; D8/91, 92, 93

[56] References Cited

U.S. PATENT DOCUMENTS

| | | | |
|---|---|---|---|
| D. 26,257 | 11/1896 | Lamotte . | |
| 74,684 | 2/1868 | Hall | 76/81.3 |
| 2,645,066 | 7/1953 | Andrews | 451/555 |
| 2,652,667 | 9/1953 | Arnold | 451/555 |
| 3,753,269 | 8/1973 | Budman | 451/444 |
| 3,882,642 | 5/1975 | Sykes | 451/555 |
| 3,924,360 | 12/1975 | Haile et al. | 76/82 |
| 4,759,153 | 7/1988 | Cohen | 76/82 |
| 4,884,343 | 12/1989 | Sewell | 76/83 |
| 5,431,597 | 7/1995 | Anderson | 76/83 |
| 5,445,050 | 8/1995 | Owens | 76/83 |
| 5,505,656 | 4/1996 | Moore | 451/555 |

*Primary Examiner*—Hwei-Siu Payer

[57] ABSTRACT

A terra cotta sharpening block for sharpening edged objects such as knives, tools, and scissors. The terra cotta sharpening block includes a block with first and second faces, a pair of ends, and a pair of sides extending between the ends of the block. The block comprises a terra cotta material.

19 Claims, 2 Drawing Sheets

TERRA COTTA SHARPENING BLOCK

BACKGROUND OF THE INVENTION

1. Field of the Invention

The present invention relates to sharpening stones and more particularly pertains to a new terra cotta sharpening block for sharpening edged objects such as knives, tools, and scissors.

2. Description of the Prior Art

The use of sharpening stones is known in the prior art. More specifically, sharpening stones heretofore devised and utilized are known to consist basically of familiar, expected and obvious structural configurations, notwithstanding the myriad of designs encompassed by the crowded prior art which have beer n developed for the fulfillment of countless objectives and requirements.

Known prior art includes U.S. Pat. No. 5,458,534; U.S. Pat. No. 3,882,642; U.S. Pat. No. Des. 287,095; U.S. Pat. No. 740,118; U.S. Pat. No. 2,645,066; and U.S. Pat. No. 5,445,050.

While these devices fulfill their respective, particular objectives and requirements, the aforementioned patents do not disclose a new terra cotta sharpening block. The inventive device includes a block with first and second faces, a pair of ends, and a pair of sides extending between the ends of the block. The block comprises a terra cotta material.

In these respects, the terra cotta sharpening block according to the present invention substantially departs from the conventional concepts and designs of the prior art, and in so doing provides an apparatus primarily developed for the purpose of sharpening edged objects such as knives, tools, and scissors.

SUMMARY OF THE INVENTION

In view of the foregoing disadvantages inherent in the known types of sharpening stones now present in the prior art, the present invention provides a new terra cotta sharpening block construction wherein the same can be utilized for sharpening edged objects such as knives, tools, and scissors.

The general purpose of the present invention, which will be described subsequently in greater detail, is to provide a new terra cotta sharpening block apparatus and method which has many of the advantages of the sharpening stones mentioned heretofore and many novel features that result in a new terra cotta sharpening block which is not anticipated, rendered obvious, suggested, or even implied by any of the prior art sharpening stones, either alone or in any combination thereof.

To attain this, the present invention generally comprises a block with first and second faces, a pair of ends, and a pair of sides extending between the ends of the block. The block comprises a terra cotta material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new terra cotta sharpening block apparatus and method which has many of the advantages of the sharpening stones mentioned heretofore and many novel features that result in a new terra cotta sharpening block which is not anticipated, rendered obvious, suggested, or even implied by any of the prior art sharpening stones, either alone or in any combination thereof.

It is another object of the present invention to provide a new terra cotta sharpening block which may be easily and efficiently manufactured and marketed.

It is a further object of the present invention to provide a new terra cotta sharpening block which is of a durable and reliable construction.

An even further object of the present invention is to provide a new terra cotta sharpening block which is susceptible of a low cost of manufacture with regard to both materials and labor, and which accordingly is then susceptible of low prices of sale to the consuming public, thereby making such terra cotta sharpening block economically available to the buying public.

Still yet another object of the present invention is to provide a new terra cotta sharpening block which provides in the apparatuses and methods of the prior art some of the advantages thereof, while simultaneously overcoming some of the disadvantages normally associated therewith.

Still another object of the present invention is to provide a new terra cotta sharpening block for sharpening edged objects such as knives, tools, and scissors.

Yet another object of the present invention is to provide a new terra cotta sharpening block which includes a block with first and second faces, a pair of ends, and a pair of sides extending between the ends of the block. The block comprises a terra cotta material.

Still yet another object of the present invention is to provide a new terra cotta sharpening block that lets a user sharpen edged objects in half the time it takes using a traditional sharpening stone made of whetstone.

Even still another object of the present invention is to provide a new terra cotta sharpening block that has a case that includes a brush for cleaning dust the surface of the block between uses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
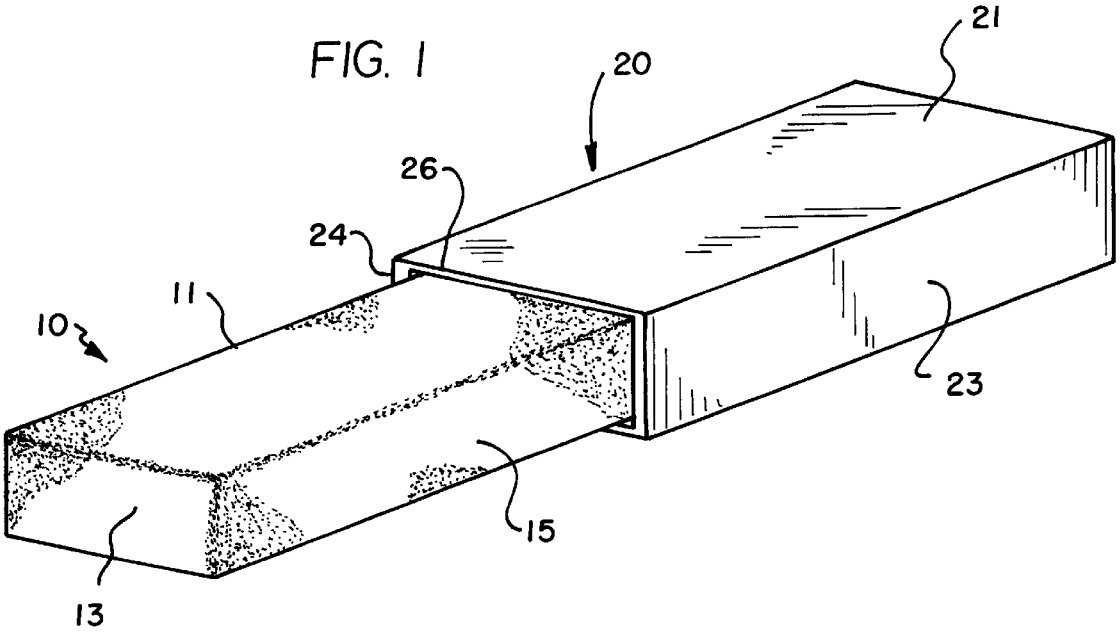
FIG. 1 is a schematic perspective view of an embodiment a new terra cotta sharpening block according to the present invention.
Figure 2:
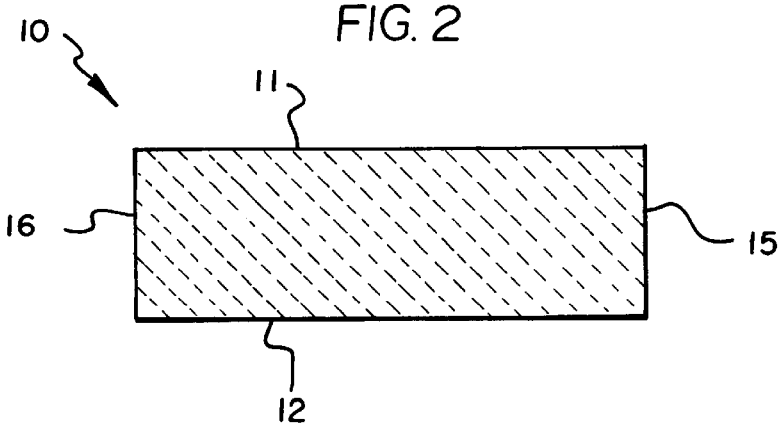
FIG. 2 is a schematic transverse cross sectional view of the block.

With reference now to the drawings, and in particular to FIGS. 1 through 4 thereof, a new terra cotta sharpening block embodying the principles and concepts of the present invention will be described.

As best illustrated in FIGS. 1 through 4, the terra cotta sharpening block system generally comprises a block 10 with first and second faces 11,12, a pair of ends 13,14, and a pair of sides 15,16 extending between the ends of the block. The block comprises a terra cotta material.

In closer detail, the sharpening system for sharpening edged objects comprises a block 10 having substantially planar and generally rectangular first and second faces 11,12, a pair of substantially planar and generally rectangular ends 13,14, and a pair of substantially planar and generally rectangular sides 15,16 extending between the ends of the block. The block comprises terra cotta all the way through the block. Terra cotta is defined for purposes of this invention as a hard, semi-fired, waterproof ceramic clay typically used in pottery and building construction. Ceramic is defined as hard, brittle, heat-resistant and corrosion-resistant material made from firing a non-metallic and non-organic material such as clay.

The ends 13,14 of the block 10 lie in substantially parallel planes to one another. The sides 15,16 of the block 10 lie in substantially parallel planes to one another substantially perpendicular to the planes of the ends 13,14 of the block 10. The second face 12 of the block 10 lies in a plane substantially perpendicular to the planes of ends 13,14 and sides 15,16 of the block 10.

In one embodiment of the invention as illustrated in FIG. 1, the first and second faces 11,12 of the block lie in substantially parallel planes to one another.

Figure 3:
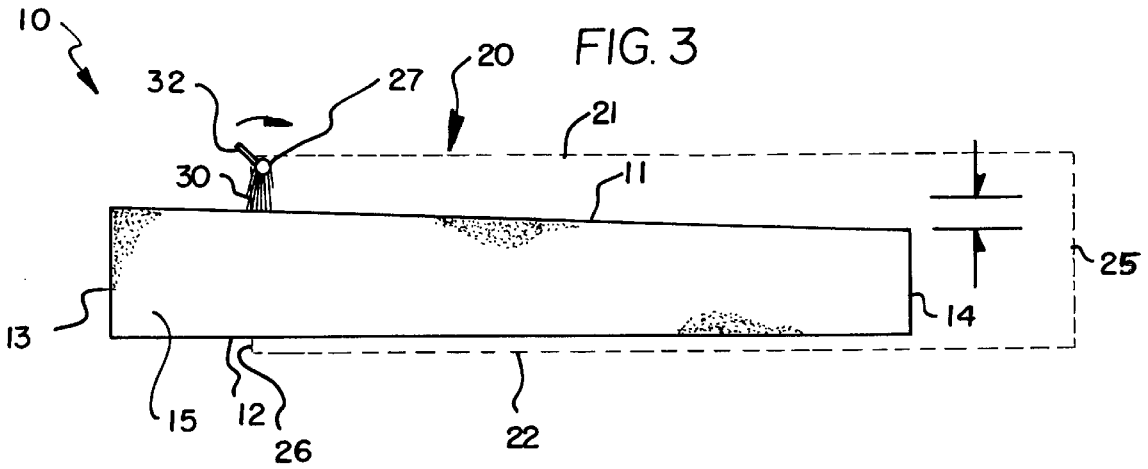
FIG. 3 is a schematic side view illustrating the preferred embodiment of the block and its relationship to bristles of the shaft in the case.

With reference to FIG. 3, in a preferred embodiment, the first and second faces 11,12 of the block lie in planes extending at an acute angle therebetween to form a slope that lets dust be brushed off of the first and second faces 11,12 while not hindering sharpening edged objects on the first and second faces. The acute angle between the first and second faces 11,12 of the block 10 is preferably between about 1 degree and about 10 degrees. Even more preferably, the acute angle between the first and second faces 11,12 of the block 10 is less than about 5 degrees. Ideally, the acute angle between the first and second faces 11,12 of the block 10 is about 2 degrees.

The block 10 has a length defined between the ends 13,14 of the block and a width defined between the sides 15,16 of the block. The length of the block is preferably between about three times and about four times greater than the width of the block to provide a preferred size to comfortably fit in the palm of the hand of a user. Ideally, the length of the block is between about 3 inches and about 4 inches to provide an optimal size to comfortably fit in the palm of the hand of a user. Ideally, the width of the block is about 1 inch to provide an optimal size to comfortably fit in the palm of the hand of a user.

The block 10 has a thickness defined between the first and second faces 11,12 of the block. Preferably, the thickness of the block at one of the ends of the block is about three-fourth the thickness of the block at another of the ends of the block. Ideally, the thickness of the block is at most about ½ inch to provide an optimal size to comfortably fit in the palm of the hand of a user.

The rectangular case 20 has generally rectangular top and bottom panels 21,22, a pair of generally rectangular side panels 23,24, a generally rectangular end panel 25 and a generally rectangular open end 26 into the case. The top and bottom panels of the case lie in substantially parallel planes to one another. The side panels 23,24 of the case lie in substantially parallel planes to one another. The end panel 25 of the case lies in a plane substantially perpendicular to the side panels 23,24 of the base. The planes of the side panels 23,24 and the end panel 25 of the case 20 extend substantially perpendicular to the top and bottom panels 21,22 of the case.

Figure 4:
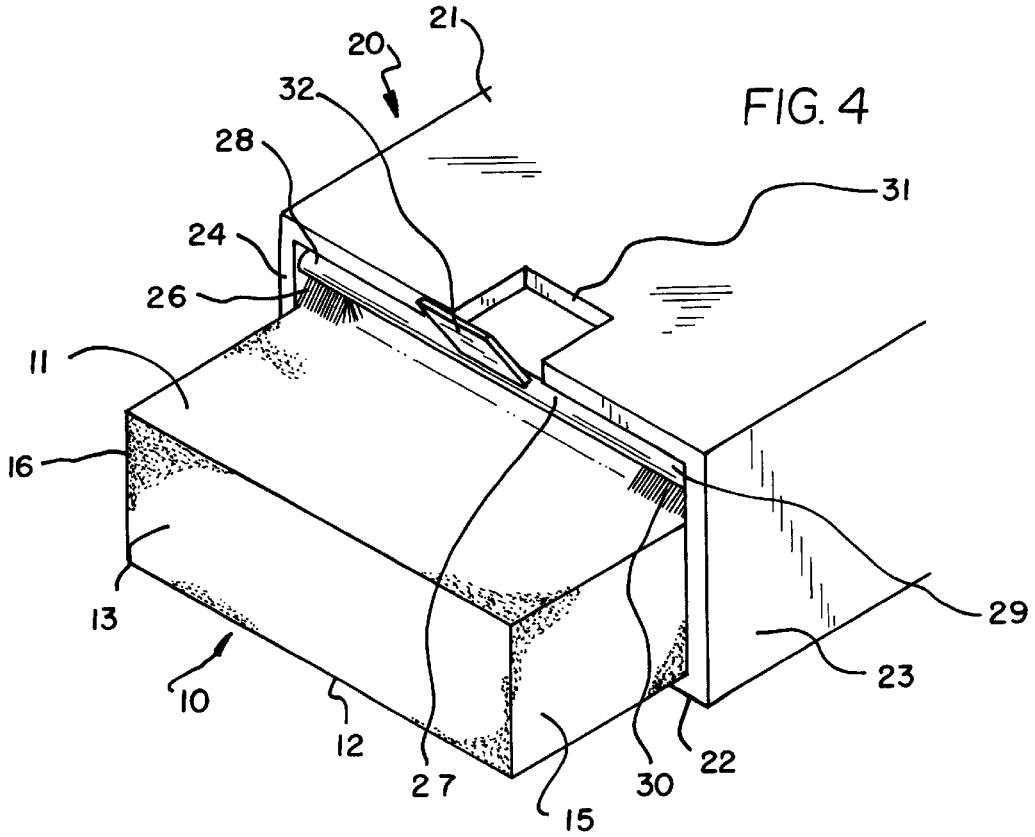
FIG. 4 is a schematic perspective view of the present invention.

The panels of the case define a generally rectangular space in the case. As illustrated in FIGS. 1, 3, and 4 one end of the block is inserted into the space of the case through the open end of the case. The space of the case is preferably sized to completely fit the block therein. In other words space of the case is shaped to receive the block and the area of the space is large enough to enclose the block.

The case has a length defined between the end panel and the open end of the case, a width defined between the side panels of the case, and a thickness defined between the top and bottom panels of the case. The length of the case is between about three times and about four times greater than the width of the case to provide a preferred size fit the block therein. Ideally, the length of the case is greater than about 3 inches to fit the block therein. In this ideal embodiment, the width of the case is greater than about 1 inch to fit the block therein. Also ideally, the thickness of the block is greater than about ½ inch to fit the block therein.

The elongate generally cylindrical shaft 27 has a pair of opposite ends 28,29 and has a longitudinal axis extending between the ends of the shaft. The shaft is positioned in the open end of the case adjacent the top panel of the case with the longitudinal axis of the shaft extending substantially parallel to the top panel of the case and to a plane in which the open end of the case lies. The ends of the shaft are rotatably coupled to the side panels of the case to permit rotation of the shaft about the longitudinal axis of the shaft. In particular, one end of the shaft is rotatably coupled to one side panel of the case and the other end of the shaft is rotatably coupled to the other side panel of the case.

The shaft has a plurality of resiliently flexible bristles 30 outwardly radiating therefrom. The bristles are arranged in a row extending between the ends of the shaft and substantially parallel to the longitudinal axis of the shaft.

The top panel of the case has a generally rectangular cutout 31 adjacent the open end of the case. The cutout of the top panel is preferably positioned about equidistant from both of the side panels of the case.

The shaft has a generally rectangular tab 32 coupled thereto. The tab is extended radially outwards from shaft preferably in a direction generally diametric to the location of the bristles on the shaft. The tab is also preferably positioned about equidistant from both of the ends of the shaft and thus the side panels of the case. This way, the tab is aligned with the cutout to permit extension of the tab into the cutout.

With reference to FIG. 3, in use, the shaft is rotatable to a position when the bristles of the shaft extend into the open end of case and are in contact with an adjacent face of the block in the case such that the bristles brush dust and debris off of the adjacent face of the block when the shaft is rotated and when the block is moved in and out of space of the case through the open end of the case. In use, the tab is designed for pushing and pulling by the thumb of a user to rotate the shaft.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sharpening system for sharpening edged objects, comprising:

a block having substantially planar and generally rectangular first and second faces, a pair of substantially planar and generally rectangular ends, and a pair of substantially planar and generally rectangular sides extending between said ends of said block;

said block comprising terra cotta;

said ends of said block lying in substantially parallel planes to each other;

said sides of said block lying in substantially parallel planes to each other substantially perpendicular to said planes of said ends of said block;

said second face of said block lying in a plane substantially perpendicular to said planes of said ends and said sides of said block;

said first and second faces of said block lying in planes extending at an acute angle therebetween;

wherein said acute angle between said first and second faces of said block is about 2 degrees;

said block having a length defined between said ends of said block;

said block having a width defined between said sides of said block;

said length of said block being between about three times and about four times greater than said width of said block;

said block having a thickness defined between said first and second faces of said block;

wherein said thickness of said block at one of said ends of said block is about three-fourth said thickness of said block at the other of said ends of said block;

a rectangular case having generally rectangular top and bottom panels, a pair of generally rectangular side panels, a generally rectangular end panel and a generally rectangular open end into said case;

said top and bottom panels of said case lying in substantially parallel planes to each other;

said side panels of said case lying in substantially parallel planes to each other;

said end panel of said case lying in a plane substantially perpendicular to said side panels of said base;

said planes of said side panels and said end panel of said case extending substantially perpendicular to said top and bottom panels of said case;

said panels of said case defining a generally rectangular space in said case;

one of said ends of said block being inserted into said space of said case through said open end of said case;

said space of said case being sized to completely fit said block therein;

said case having a length defined between said end panel and said open end of said case, a width defined between said side panels of said case and a thickness defined between said top and bottom panels of said case;

said length of said case being between about three times and about four times greater than said width of said case;

an elongate generally cylindrical shaft having a pair of opposite ends and having a longitudinal axis extending between said ends of said shaft;

said shaft being positioned in said open end of said case adjacent said top panel of said case, said longitudinal axis of said shaft being extended substantially parallel to said top panel of said case and to a plane in which said open end of said case lies;

said ends of said shaft being rotatably coupled to said side panels of said case to permit rotation of said shaft about said longitudinal axis of said shaft;

one of said ends of said shaft being rotatably coupled to one of said side panels of said case, the other of said ends of said shaft being rotatably coupled to the other of said side panels of said case;

said shaft having a plurality of resiliently flexible bristles outwardly radiating therefrom, said bristles being arrange in a row extending between said ends of said shaft and substantially parallel to said longitudinal axis of said shaft;

said top panel of said case having a generally rectangular cutout adjacent said open end of said case, said cutout of said top panel being positioned about equidistant from said side panels of said case;

said shaft having a generally rectangular tab coupled thereto, said tab being extended radially outwards from said shaft in a direction generally diametric to the location of said bristles on said shaft;

said tab being positioned about equidistant from said ends of said shaft and said side panels of said case;

said tab being aligned with said cutout to permit extension of said tab into said cutout; and said shaft being rotatable to a position when said bristles of said shaft extend into said open end of case and are in contact with an adjacent face of said block in said case such that said bristles brush dust and debris off of the adjacent face of the block when said shaft is rotated and when said block is moved in and out of space of said case through said open end of said case.

2. A sharpening system for sharpening edged objects, comprising:

a block having first and second faces, a pair of ends, and a pair of sides extending between said ends of said block;

said block comprising terra cotta and being for sharpening edged objects thereon;

a case having top and bottom panels, a pair of side panels, an end panel and an open end into said case, said panels of said case defining a generally rectangular space in said case, one of said ends of said block being inserted into said space of said case through said open end of said case; and an elongate shaft having a pair of opposite ends and having a longitudinal axis extending between said ends of said shaft, said shaft being positioned in said open end of said case adjacent said top panel of said case, said ends of said shaft being rotatable coupled to said side panels of said case to permit rotation of said shaft about said longitudinal axis of said shaft.

3. The sharpening system of claim 2, wherein said block has a length defined between said ends of said block, and a width defined between said sides of said block, said length of said block being between about three times and about four times greater than said width of said block.

4. The sharpening system of claim 2, wherein said top and bottom panels of said case lie in substantially parallel planes to each other, wherein said side panels of said case lie in substantially parallel planes to each other, wherein said end panel of said case lie in a plane substantially perpendicular to said side panels of said base, and wherein said planes of said side panels and said end panel of said case extend substantially perpendicular to said top and bottom panels of said case.

5. The sharpening system of claim 2, wherein said space of said case is sized to completely fit said block therein.

6. The sharpening system of claim 2, wherein said shaft has a plurality of resiliently flexible bristles outwardly radiating therefrom, said bristles being arrange in a row extending between said ends of said shaft.

7. The sharpening system of claim 6, wherein said top panel of said case has a generally rectangular cutout adjacent said open end of said case, and wherein said shaft has a generally rectangular tab coupled thereto, said tab being extended radially outwards from said shaft, said tab being aligned with said cutout to permit extension of said tab into said cutout.

8. A sharpening system for sharpening edged objects, comprising:

a block having first and second faces, a pair of ends, and a pair of sides extending between said ends of said block;

said block comprising terra cotta and being for sharpening edged objects thereon;

wherein said ends of said block lie in substantially parallel planes to each other, wherein said sides of said block lie in substantially parallel planes to each other substantially perpendicular to said planes of said ends of said block, and wherein said second face of said block lies in a plane substantially perpendicular to said planes of said ends and said sides of said block; and wherein said first and second faces of said block lie in planes extending at an acute angle therebetween.

9. The sharpening system of claim 8, wherein said acute angle between said first and second faces of said block is between about 1 degree and about 10 degrees.

10. The sharpening system of claim 8, wherein said acute angle between said first and second faces of said block is less than about 5 degrees.

11. The sharpening system of claim 8, wherein said acute angle between said first and second faces of said block is about 2 degrees.

12. The sharpening system of claim 8, wherein said block has a length defined between said ends of said block, and a width defined between said sides of said block, said length of said block being between about three times and about four times greater than said width of said block.

13. The sharpening system of claim 8, wherein said block has a thickness defined between said first and second faces of said block, wherein said thickness of said block at one of said ends of said block is about three-fourth said thickness of said block at the other of said ends of said block.

14. The sharpening system of claim 8, further comprising a case having top and bottom panels, a pair of side panels, an end panel and an open end into said case, said panels of said case defining a generally rectangular space in said case, one of said ends of said block being inserted into said space of said case through said open end of said case.

15. The sharpening system of claim 14, wherein said top and bottom panels of said case lie in substantially parallel planes to each other, wherein said side panels of said case lie in substantially parallel planes to each other, wherein said end panel of said case lie in a plane substantially perpendicular to said side panels of said base, and wherein said planes of said side panels and said end panel of said case extend substantially perpendicular to said top and bottom panels of said case.

16. The sharpening system of claim 14, wherein said space of said case is sized to completely fit said block therein.

17. The sharpening system of claim 14, further comprising an elongate shaft having a pair of opposite ends and having a longitudinal axis extending between said ends of said shaft, said shaft being positioned in said open end of said case adjacent said top panel of said case, said ends of said shaft being rotatably coupled to said side panels of said case to permit rotation of said shaft about said longitudinal axis of said shaft.

18. The sharpening system of claim 17, wherein said shaft has a plurality of resiliently flexible bristles outwardly radiating therefrom, said bristles being arrange in a row extending between said ends of said shaft.

19. The sharpening system of claim 18, wherein said top panel of said case has a generally rectangular cutout adjacent said open end of said case, and wherein said shaft has a generally rectangular tab coupled thereto, said tab being extended radially outwards from said shaft, said tab being aligned with said cutout to permit extension of said tab into said cutout.

* * * * *